US005769654A

United States Patent [19]

Onoda

[11] Patent Number: 5,769,654

[45] Date of Patent: Jun. 23, 1998

[54] PRESS-CONNECTING TERMINAL

[75] Inventor: Katsuhiko Onoda, Shizuoka, Japan

[73] Assignee: Yazaki Corporation, Tokyo, Japan

[21] Appl. No.: 902,284

[22] Filed: Jul. 29, 1997

Related U.S. Application Data

[63] Continuation of Ser. No. 495,841, Jun. 28, 1995, abandoned.

[30] Foreign Application Priority Data

Jun. 29, 1994 [JP] Japan ..... 6-148012

[51] Int. Cl.[6] ..... H01R 4/24

[52] U.S. Cl. ..... 439/393; 439/397; 439/399

[58] Field of Search ..... 439/393, 397, 439/399, 404

[56] References Cited

U.S. PATENT DOCUMENTS

| | | | |
|---|---|---|---|
| 4,089,580 | 5/1978 | Huffnagle et al. | 439/404 |
| 4,097,107 | 6/1978 | Hawkins | 439/397 |
| 4,270,831 | 6/1981 | Takahashi | 439/397 |
| 4,660,917 | 4/1987 | DeRoss et al. | 439/404 |
| 5,041,006 | 8/1991 | Van Zanten et al. | 439/397 |
| 5,139,434 | 8/1992 | Goodman | 439/399 |
| 5,447,449 | 9/1995 | Kaneko | 439/397 |

FOREIGN PATENT DOCUMENTS

| | | | |
|---|---|---|---|
| 136007 | 4/1985 | European Pat. Off. | 439/397 |
| 298819 | 1/1989 | European Pat. Off. | 439/397 |
| 2-137756 | 11/1990 | Japan | H01R 4/24 |

*Primary Examiner*—Gary E. Elkins
*Attorney, Agent, or Firm*—Sughrue, Mion, Zinn, Macpeak & Seas, PLLC

[57] ABSTRACT

A press-connecting terminal to which an insulated wire is press-connected. A pair of press-connecting blades are formed on opposite sides of the press-connecting terminal, and are arranged alternately at a predetermined interval. Each of the press-connecting blades has a contact portion which is held in contact with a side surface of a partition wall of a connector housing, and the wire is press-fitted into a space between the press-connecting blade and the side surface of the partition wall, thereby press-connecting the wire to the terminal.

16 Claims, 4 Drawing Sheets

PRESS-CONNECTING TERMINAL

This is a Continuation of application Ser. No. 08/495,841 filed Jun. 28, 1995 abandoned.

BACKGROUND OF THE INVENTION

1. Field of the Invention

This invention relates to a press-connecting terminal structure in which an insulated wire is press-connected to press-connecting blades formed on a metal base plate, and more particularly to such a structure for use with a thick wire of a large diameter such as a wire harness used in an automobile.

2. Description of the Related Art

A wire harness for an automobile tends to have a large diameter because a large current of low voltage flows through it, and to improve the efficiency of the wiring operation, press-connecting terminals have heretofore been extensively used. FIGS. 8 and 9 show one such conventional press-connecting terminal 11 (Japanese Utility Model Unexamined Publication No. Hei. 2-137756). Basically, the terminal 11 is formed by shaping a metal sheet, and includes a base plate 1, a connection terminal portion 2 formed at one end of the base plate 1, and a wire connection portion 3 formed at a substantially central position of the base plate 1. A wire W is press-connected to the wire connection portion 3.

The wire connection portion 3 has a wire press-connecting conductive frame (hereinafter referred to as "conductive frame") 4, and a reinforcing plate portion 5. As will be more fully described later with reference to FIG. 9, the conductive frame 4 and the reinforcing plate portion 5 are formed by bending the single metal sheet. The conductive frame 4 has a U-shape in plane, and includes an upstanding side wall portion 6 formed along one longitudinal side edge of the metal base plate 1 by bending, a pair of opposed wall portions 6*a* and 6*b* formed by perpendicularly bending opposite end portions of the side wall portion 6 into opposed relation to each other, and a pair of reinforcing wall portions 7*a* and 7*b* formed by perpendicularly bending opposite end portions of the opposed wall portions 6*a* and 6*b* away from each other. Press-connecting blades 8 and 9 are formed on the pair of opposed wall portions 6*a* and 6*b*, respectively.

The upstanding reinforcing plate portion 5 is formed on the other longitudinal side edge of the base plate 1 by bending, and closes an open side of the U-shaped conductive frame 4. The reinforcing plate portion 5 is fixed to the reinforcing wall portions 7*a* and 7*b* by kinking or bending a pair of tongues 12, thereby imparting rigidity to the opposed wall portions 6*a* and 6*b*. A pair of holder portions 13 are formed on the other end of the metal base plate 1, and serve to retain the wire W, press-connected to the blades 8 and 9, against disconnection.

FIG. 9 is a developed view of the press-connecting terminal 11, and the base plate 1, having the side wall portion 6 and the reinforcing plate portion 5 formed respectively on the opposite longitudinal side edges thereof, is formed by blanking. In the shaping of the metal sheet, the side wall portion 6 is first raised to form the conductive frame 4, and then the reinforcing plate portion 5 is raised, and is fixed to the reinforcing wall portions 7*a* and 7*b* by kinking or bending the tongues 12.

The wire W is press-fitted into the press-connecting blades 8 and 9 from the upper side, so that these blades 8 and 9 cut through the insulation of the wire W to be brought into contact with a conductor of the wire W. Then, the wire W is held between the holder portions 13, and the holder portions 13 are deformed to retain the wire W against disconnection.

In the press-connecting terminal of the above construction, the reinforcing plate portion 5 is provided for preventing the press-connecting blades 8 and 9 from falling when the wire W is press-fitted into these blades 8 and 9, and this reinforcing plate portion 5 is fixedly secured to the reinforcing wall portions 7*a* and 7*b* by bending the tongues 12. Therefore, the width of the press-connecting terminal 11 is increased by an amount corresponding to the thickness of the reinforcing plate portion 5. Furthermore, because of the provision of the reinforcing plate portion 5, the amount of material (that is, the metal sheet) to be used increases.

One recent trend in technology is toward compact, lightweight design of electronic devices, and various parts have been designed to have a compact, lightweight construction. In view of this, even the thickness of the reinforcing plate portion 5 can not be neglected, and it is desirable to obviate the need for this reinforcing plate portion 5. In the conventional construction, however, if the reinforcing plate portion 5 were omitted, the pair of opposed wall portions 6*a* and 6*b* would be moved away from each other or fall, thus adversely affecting the press-connecting of the wire W, and the pair of opposed wall portions 6*a* and 6*b* could be easily deformed during maintenance.

Furthermore, since a large number of press-connecting terminals 11 are used, the areas of the reinforcing plate portions 5 amount to an enormous quantity of material in the case of mass production. If the provision of the reinforcing plate portion 5 can be omitted, more press-connecting terminals can be blanked from one metal sheet, thus achieving economy of scale. In the conventional press-connecting terminal structure, however, the reinforcing plate portion can not be omitted for the above-mentioned reasons, and this is a barrier to the compact design of the terminal, increases the time and labor for production of the terminal, and increases the cost of the terminal.

SUMMARY OF THE INVENTION

It is therefore an object of this invention to provide a press-connecting terminal in which press-connecting blades are prevented from deforming, and many terminals can be blanked from a single metal sheet, thereby reducing the cost.

In order to attain the above object, the invention provides a press-connecting terminal including: a base portion having one end portion serving as a connection terminal portion; and a pair of press-connecting blades formed respectively on opposite sides of the base portion and arranged alternately at a predetermined interval, the pair of press-connecting blades being formed by blanking and bent into opposed relation to each other.

DETAILED DESCRIPTION OF THE PREFERRED EMBODIMENT

Figure 1:
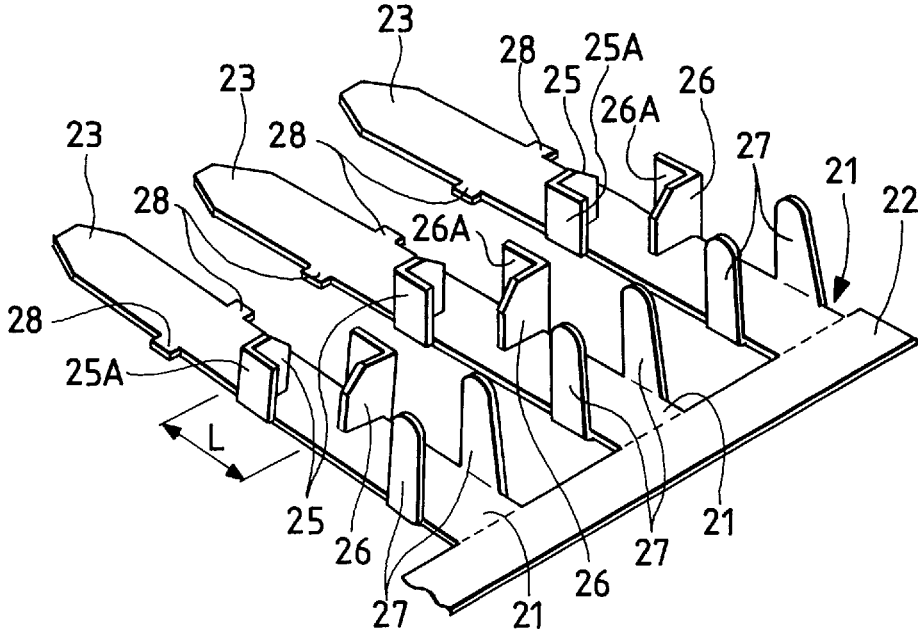
FIG. 1 is a perspective view showing the configuration of press-connecting terminals according to an embodiment of the present invention.

A preferred embodiment of a press-connecting connector of the present invention will now be described with reference to FIGS. 1 to 7. The press-connecting connector T includes press-connecting terminals 21 formed by working a metal sheet, and a connector housing 31. Press-connecting blades 25 and 26 and etc., are formed integrally on the press-connecting terminal 21. The construction of the press-connecting connector T will first be described with reference to FIGS. 1 and 2. FIG. 1 is a perspective view showing the configuration of the press-connecting terminals 21 for the press-connecting connector T. The elongate press-connecting terminals 21 are formed by blanking from a single metal sheet 22, and are connected together at predetermined intervals, one end portion of each terminal 21 constituting a connection terminal portion 23. The press-connecting terminals 21 are finally separated from the metal sheet 22 as indicated by a broken line in FIG. 1.

The press-connecting blades 25 and 26 each having an L-shape or hook-shape in plane are formed respectively on opposite sides of a base portion (one end portion of which forms the connection terminal portion 23) of the press-connecting terminal 21, and are arranged alternately at a predetermined interval L. Holder portions (insulation barrel) 27 for retaining a wire W against disconnection are formed on the other end portion of the base portion of the terminal 21 adjacent to the line of cutting. Retaining portions 28 are formed integrally on the base portion of the terminal 21 between the press-connecting blade 25 and the connection terminal portion 23. The retaining portions 28 serve as disconnection prevention portions when the press-connecting terminal 21 is insert-molded in the connector housing 31.

Figure 2:
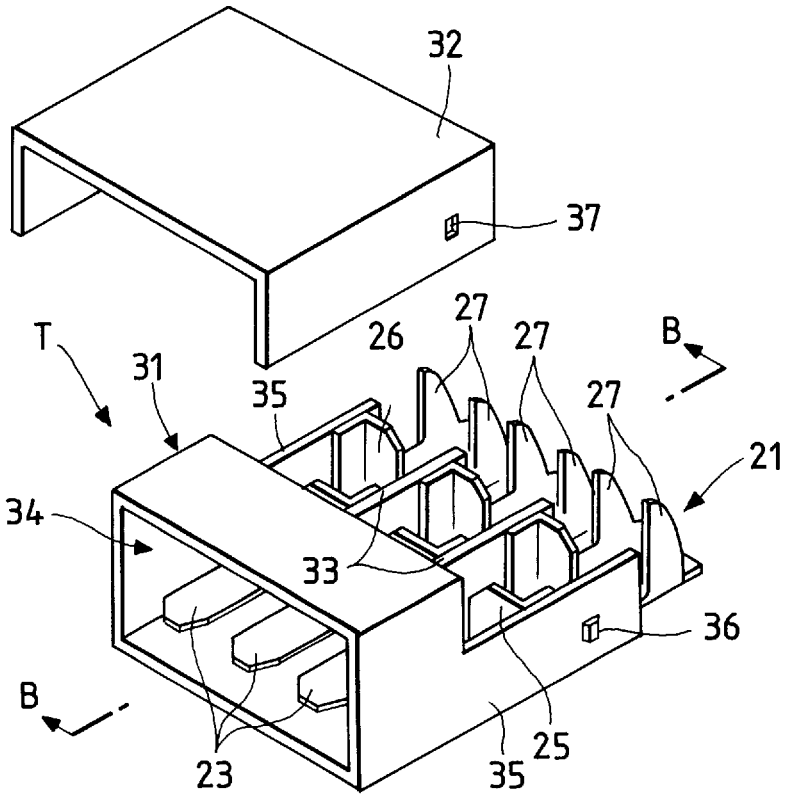
FIG. 2 is a perspective view showing the construction of a press-connecting connector.

In the press-connecting connector T, the press-connecting terminals 21 are insert-molded in the connector housing 31 as shown in FIG. 2. The wires W are press-connected to the press-connecting terminals 21, respectively, and then a cover 32 is attached to the connector housing 31. Partition walls 33 are formed on the connector housing 31 at a predetermined interval, and cooperate with opposite side walls 35 of the connector housing 31 to form three receiving spaces. The insert molding is effected such that the press-connecting terminals 21 are disposed in these receiving spaces, respectively. A space 34 is defined by frame-like one end portion of the housing 31, and the connection terminal portions 23 extend into the space 34. The configuration of the interior of the housing 31 and the insert configuration of the press-connecting terminal 21 will be more fully described later with reference to the drawings.

A retaining projection 36 is formed on an outer surface of each of the opposite side walls 35 of the connector housing 31, and a retaining hole 37 is formed through each of opposite side walls of the cover 32. The cover 32 is attached to the housing 31, with the retaining projections 36 engaged respectively in the retaining holes 37, thus integrally connecting the housing 31 and the cover 32 together.

Figure 3:
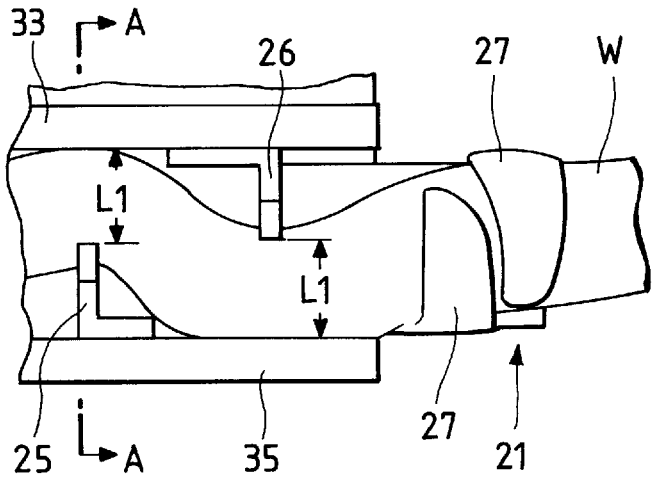
FIG. 3 is a plan view press-connecting of a wire.

A method of press-connecting the wire W will now be described with reference to FIGS. 3 and 4.

When the connector, having the press-connecting terminals 21 insert-molded in the housing 31, is viewed from the top, the inner sides of the press-connecting blades 25 and 26 are opposed to each other, and a meandering space is formed between the two blades 25 and 26. The distal end of each press-connecting blade 25 or 26 is spaced a predetermined distance L1 from the partition wall 33 or the side wall 35 since the partition walls 33 are spaced at a predetermined interval. The distance L1 is set to be smaller than the diameter of the wire W. Therefore, when the wire W is press-fitted into the meandering space from above the press-connecting terminal 21, with the cover 32 removed as shown in FIG. 2, the press-connecting blades 25 and 26 cut through the insulation of the wire W, and the wire W is extended toward the holder portions 27 in a meandering or bent manner.

Figure 4:
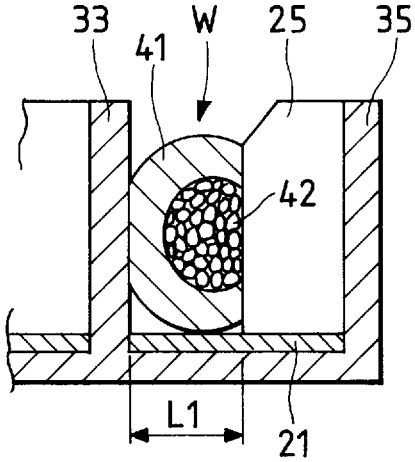
FIG. 4 is a cross-sectional view taken along the line A—A of FIG. 3.

Regarding the connection between the wire W and the press-connecting blade 25 (that is, between the wire W and the press-connecting terminal 21), the press-connecting blade 25 cuts through the insulation 41 of the wire W, and a blade edge is press-connected to a conductor 42 of the wire W as shown in FIG. 4. As described above, the distance L1 is smaller than the diameter of the wire W, and therefore when the wire W is press-fitted, the press-connecting blade 25 is brought into intimate contact with the conductor 42. Thus, the terminal can be electrically connected to the wire W with a low resistance. The connector housing 31 is integrally molded of a synthetic resin, and therefore the distance between the partition walls 33 is accurately the predetermined value, and the distance L1 is not varied. Therefore, the contact between the conductor 42 and the press-connecting blade 25 or 26 is uniform, thereby improving the reliability of the product. Such press-connecting is also effected with the other press-connecting blade 26, and one end portion of the wire W thus press-connected is clamped against disconnection by bending the holder portions 27.

Although there is exerted a force urging the press-connecting blades 25 and 26 outward when press-connecting the wire W, the press-connecting blades 25 and 26 will not be deformed since the rear side of each of the press-connecting blades 25 and 26 is held against the partition wall 33 or the side wall 35. This effect will be more fully described later with reference to the developed configuration of the press-connecting terminal 21.

Figure 5:
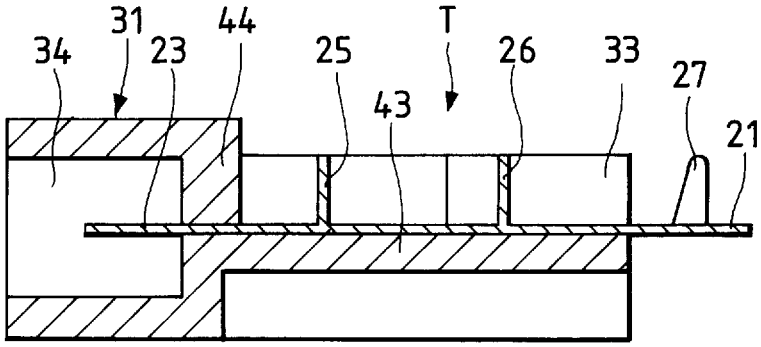
FIG. 5 is a cross-sectional view taken along the line B—B of FIG. 2.
Figure 6:
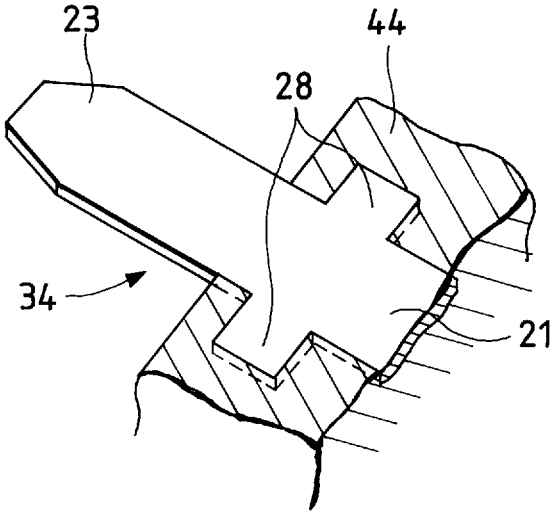
FIG. 6 is a cross-sectional view, showing insertion of the press-connecting terminal.

Next, the insertion of the press-connecting terminal 21 in the connector housing 31 will be described with reference to FIGS. 5 and 6. A major portion of the base portion of the press-connecting terminal 21 on which the press-connecting blades 25 and 26 are formed is positioned on a thick bottom plate portion 43 of the connector housing 31. The retaining portions 28 of the press-connecting terminal 21 are positioned in a thick partition wall 44 which defines, together with other associated walls, the space 34, as shown in FIG. 6. The press-connecting terminal 21 is partially embedded in the partition wall 44 of a synthetic resin.

With this construction, even if a downward force is exerted on the press-connecting terminal 21 when press-connecting the wire W thereto, this terminal will not be easily deformed, and since the retaining portions 28 are embedded in the partition wall 44 and hence the connector housing 31, the terminal 21 is prevented from rearward disconnection from the connector housing 31.

Figure 7:
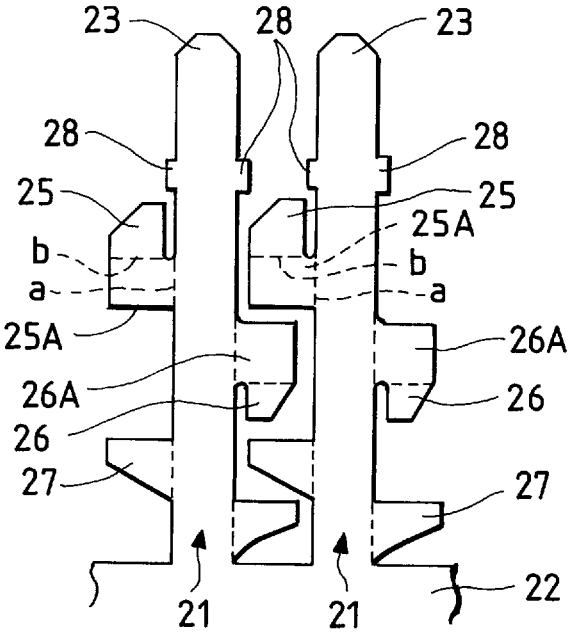
FIG. 7 is a developed view showing the press-connecting terminals.
Figure 8:
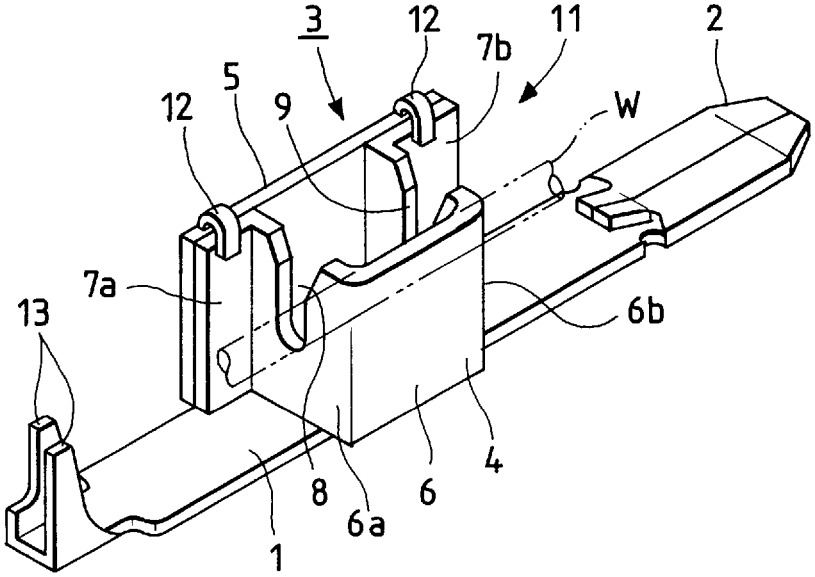
FIG. 8 PRIOR ART
FIG. 8 is a perspective view showing a conventional press-connecting terminal.
Figure 9:
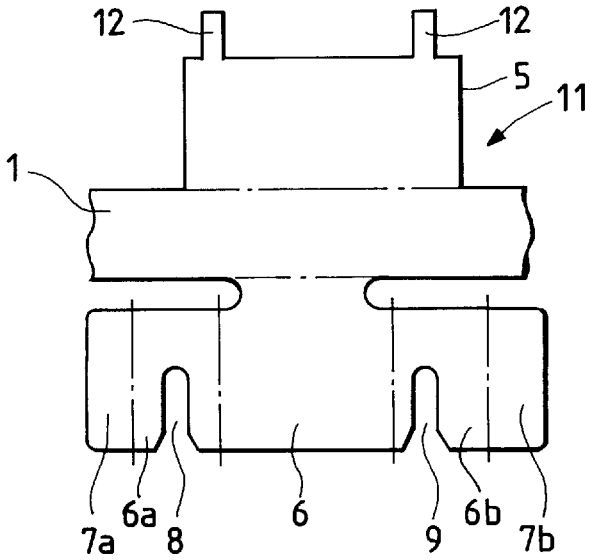
FIG. 9 PRIOR ART
FIG. 9 is a developed view showing the conventional press-connecting terminal.

Next, the press-connecting terminal 21 in its flat configuration will now be described with reference to FIG. 7. In this embodiment, the press-connecting terminal 21 has the hook-shaped press-connecting blades 25 and 26, as well as the holder portions 27, formed on opposite sides of the elongate base portion, respectively, and the press-connecting terminals 21 are first formed in an interconnected manner. The press-connecting blades 25 and 26, as well as the holder portions 27, are diagonally opposed to each other with respect to the base portion of the terminal 21. Therefore, in FIG. 7, the press-connecting blade 25 of the right press-connecting terminal 21 can be formed at an area of the metal sheet 22 disposed adjacent to a forward edge of the press-connecting blade 26 of the left press-connecting terminal 21. The holder portions 27 can be also formed in a similar manner. With this configuration, a die for blanking the press-connecting terminals 21 is designed to reduce waste of the metal sheet 22. Therefore, the yield of the material is greatly enhanced, and the cost of the terminal is reduced.

More importantly, each of the press-connecting blades 25 and 26 in its developed shape has an L-shape, and it is first bent along a line a, and then is bent along a line b, so that the thus shaped press-connecting blades 25 and 26 has an L-shape or hook-shape in plane as shown in the drawings. The thus shaped press-connecting blades 25 and 26 have flat contact portions 25A and 26A respectively for contact with the inner surface of the side wall 35 or one side of the partition wall 33. Thus, when the press-connecting terminal 21 is insert-molded in the connector housing 31, a rear surface of each of the contact portions 25A and 26A is held in contact with one side of the partition wall 33 or the inner surface of the side wall 35.

With this construction, even if a force urging the press-connecting blades 25 and 26 outward acts on these blades during the press-connecting of the wire W, each of the blades 25 and 26 is supported by the partition wall 33 or the side wall 35 through the contact portion 25A or 26A, thereby preventing the deformation of the press-connecting blades 25 and 26, thus achieving good contact between the blades 25 and 26 and the conductor 42.

As described above, in the press-connecting terminal of the present invention, the pair of alternately-arranged, press-connecting blades are formed respectively on opposite sides of the terminal blanked from the metal sheet. The press-connecting blade has a contact portion held in contact with the side surface of the partition wall of the connector housing. The wire is press-fitted into the space between the side surface of the partition wall and the press-connecting blade, thereby press-connecting the wire.

With this construction, when the wire is to be press-connected, the press-connecting blade is supported by the side surface of the partition wall through the contact portion, thereby preventing the deformation of the press-connecting blade. The press-connecting blades are arranged alternately at a predetermined interval, and therefore the wire, after being press-connected, is extended in a meandering manner, thus accomplishing the press-connecting operation and the disconnection preventing operation at the same time.

The press-connecting blades are arranged alternately on opposite sides of the base portion respectively, and each of the press-connecting blades has a contact portion for preventing deformation of less blade. Therefore, the metal sheet is wasted when blanking the press-connecting terminals from the metal sheet, and the effective area of the metal sheet used for forming the terminals is increased, thereby reducing the cost of the terminal.

What is claimed is:

1. A press-connecting terminal comprising:

a base portion having one end portion serving as a connection terminal portion; and a single pair of press-connecting blades alternately disposed at a predetermined interval on opposite sides of said base portion to form a meandering space between said press-connecting blades for accommodating a wire to be press-connected.

2. A press-connecting terminal assembly, comprising:

a connector housing; and a press-connecting terminal comprising a base portion having one end portion serving as a connection terminal portion and only a single pair of press-connecting blades alternately disposed at a predetermined interval on opposite sides of said base portion to form a meandering space between said press-connecting blades for accommodating a wire to be press-connected;

wherein at least said base portion is integrally disposed in said connector housing.

3. A press-connecting terminal assembly comprising:

a connector housing; and a press-connecting terminal comprising a base portion having one end portion serving as a connection terminal portion and a pair of press-connecting blades alternately disposed at a predetermined interval on opposite sides of said base portion to form a meandering space between said press-connecting blades for accommodating a wire to be press-connected;

wherein at least said base portion is integrally disposed in said connector housing; and wherein said connector housing comprises a plurality of partition walls, and each said press-connecting blade has a contact portion which contacts one of said partition walls to prevent deformation of said press-connecting blades when press-connecting a wire to said press-connecting blades.

4. The press-connecting terminal assembly according to claim 3, wherein a distance between a distal end of each said press-connecting blade and one of said partition walls opposed to said press-connecting blade is smaller than the diameter of said wire to be press-connected to said press-connecting blades.

5. A press-connecting terminal assembly comprising:

a connector housing; and a press-connecting terminal comprising a base portion having one end portion serving as a connection terminal portion and a pair of press-connecting blades alternately disposed at a predetermined interval on opposite sides of said base portion to form a meandering space between said press-connecting blades for accommodating a wire to be press-connected;

wherein said base portion is insert-molded in the connector housing and integrally disposed therein against disconnection from said connector housing.

6. The press-connecting terminal assembly according to claim 5, wherein said base portion further comprises a retaining portion for preventing said base portion from disconnection from said connector housing.

7. A press-connecting terminal comprising:

a base portion having one end portion serving as a connection terminal portion; and a pair of press-connecting blades alternately disposed at a predetermined interval on opposite sides of said base portion to form a meandering space between said press-connecting blades for accommodating a wire to be press-connected;

wherein said base portion further comprises a holder portion for preventing disconnection of a wire press-connected to said press-connecting blades.

8. A press-connecting terminal assembly comprising:

a connector housing; and a press-connecting terminal comprising a base portion having one end portion serving as a connection terminal portion and a pair of press-connecting blades alternately disposed at a predetermined interval on opposite sides of said base portion to form a meandering space between said press-connecting blades for accommodating a wire to be press-connected;

wherein at least said base portion is integrally disposed in said connector housing; and wherein said base portion further comprises a holder portion for preventing disconnection of a wire press-connected to said press-connecting blades.

9. A press-connecting terminal comprising:

a base portion having one end portion serving as a connection terminal portion, a first side, and a second side;

a first press-connecting blade disposed on said first side of said base portion and extending partially across said base portion towards said second side of said base portion; and a second press-connecting blade disposed on said second side of said base portion and extending partially across said base portion towards said first side of said base portion, said first and second press-connecting blades being at different longitudinal positions relative to one another along the length of said terminal;

wherein said first and second press-connecting blades are the only press-connecting blades of said terminal.

10. A press-connecting terminal assembly, comprising:

a connector housing; and a press-connecting terminal comprising a base portion having one end portion serving as a connection terminal portion, a first side, and a second side; a first press-connecting blade disposed on said first side of said base portion and extending partially across said base portion towards said second side of said base portion; and a second press-connecting blade disposed on said second side of said base portion and extending partially across said base portion towards said first side of said base portion, said first and second press-connecting blades being at different longitudinal positions relative to one another along the length of said terminal;

wherein said first and second press-connecting blades are the only press-connecting blades of said terminal; and wherein at least said base portion is integrally disposed in said connector housing.

11. The press-connecting terminal assembly according to claim 10, wherein said connector housing comprises a plurality of partition walls, and each of said first and second press-connecting blades has a contact portion which contacts one of said partition walls to prevent deformation of said first and second press-connecting blades when press-connecting a wire to said first and second press-connecting blades.

12. A press-connecting terminal assembly comprising:

a connector housing; and a press-connecting terminal comprising a base portion having one end portion serving as a connection terminal portion, a first side, and a second side; a first press-connecting blade disposed on said first side of said base portion and extending partially across said base portion towards said second side of said base portion; and a second press-connecting blade disposed on said second side of said base portion and extending partially across said base portion towards said first side of said base portion, said first and second press-connecting blades being at different longitudinal positions relative to one another along the length of said terminal;

wherein at least said base portion is integrally disposed in said connector housing;

wherein said connector housing comprises a plurality of partition walls, and each of said first and second press-connecting blades has a contact portion which contacts one of said partition walls to prevent deformation of said first and second press-connecting blades when press-connecting a wire to said first and second press-connecting blades; and wherein a distance between a distal end of each of said first and second press-connecting blades and one of said partition walls opposed to said press-connecting blade is smaller than the diameter of said wire to be press-connected to said first and second press-connecting blades.

13. A press-connecting terminal assembly comprising:

a connector housing; and a press-connecting terminal comprising a base portion having one end portion serving as a connection terminal portion, a first side, and a second side; a first press-connecting blade disposed on said first side of said base portion and extending partially across said base portion towards said second side of said base portion; and a second press-connecting blade disposed on said second side of said base portion and extending partially across said base portion towards said first side of said base portion, said first and second press-connecting blades being at different longitudinal positions relative to one another along the length of said terminal;

wherein said base portion is insert-molded in the connector housing and integrally disposed therein against disconnection from said connector housing.

14. The press-connecting terminal assembly according to claim 13, wherein said base portion further comprises a retaining portion for preventing said base portion from disconnection from said connector housing.

15. A press-connecting terminal assembly comprising:

a base portion having one end portion serving as a connection terminal portion, a first side, and a second side;

a first press-connecting blade disposed on said first side of said base portion and extending partially across said base portion towards said second side of said base portion; and a second press-connecting blade disposed on said second side of said base portion and extending partially across said base portion towards said first side of said base portion, said first and second press-connecting blades being at different longitudinal positions relative to one another along the length of said terminal;

wherein said base portion further comprises a holder portion for preventing disconnection of a wire press-connected to said first and second press-connecting blades.

16. A press-connecting terminal assembly comprising:

a connector housing; and a press-connecting terminal comprising a base portion having one end portion serving as a connection terminal portion, a first side, and a second side; a first press-connecting blade disposed on said first side of said base portion and extending partially across said base portion towards said second side of said base portion; and a second press-connecting blade disposed on said second side of said base portion and extending partially across said base portion towards said first side of said base portion, said first and second press-connecting blades being at different longitudinal positions relative to one another along the length of said terminal;

wherein at least said base portion is integrally disposed in said connector housing;

wherein said base portion further comprises a holder portion for preventing disconnection of a wire press-connected to said first and second press-connecting blades.

* * * * *